US005878539A

United States Patent [19]

Grubb

[11] Patent Number: 5,878,539

[45] Date of Patent: Mar. 9, 1999

[54] METHOD AND APPARATUS FOR A TUBULAR SKYLIGHT SYSTEM

[76] Inventor: Dennis Grubb, 5230 E. Hearn Rd., Scottsdale, Ariz. 85254

[21] Appl. No.: 871,222

[22] Filed: Jun. 9, 1997

[51] Int. Cl.[6] ..... E04D 13/03

[52] U.S. Cl. ..... 52/200; 52/199

[58] Field of Search ..... 52/198–200, 80.1, 52/82, 3, 107, 94, 302.1, 302.6, 209; 359/591–593, 597, 598

[56] References Cited

U.S. PATENT DOCUMENTS

| | | | |
|---|---|---|---|
| 3,012,375 | 12/1961 | Wasserman | 52/200 |
| 3,984,947 | 10/1976 | Patry | 52/199 X |
| 4,339,900 | 7/1982 | Freeman | 52/200 |
| 4,593,504 | 6/1986 | Bonnici et al. | 52/199 |
| 5,099,622 | 3/1992 | Sutton . | |
| 5,502,935 | 4/1996 | Demmer | 52/200 |
| 5,546,712 | 8/1996 | Bixby | 52/200 |
| 5,561,952 | 10/1996 | Damron | 52/198 |
| 5,581,447 | 12/1996 | Raasakka | 362/32 |
| 5,596,848 | 1/1997 | Lynch | 52/200 |
| 5,655,339 | 8/1997 | DeBlock et al. | 52/200 |

*Primary Examiner*—Carl D. Friedman
*Assistant Examiner*—Beth A. Aubrey
*Attorney, Agent, or Firm*—Snell & Wilmer L.L.P.

[57] ABSTRACT

The present invention includes an improved tubular skylight system having a clear acrylic outer dome, an aluminum flashing, an aluminum light tube, an aluminum ceiling plaster ring, and a prismatic diffuser. The outer dome includes an aluminum ring around the base of the dome which contains a circular channel and holes which provide for increased heat dissipation and condensation removal. The aluminum ring allows the outer acrylic dome to be attached directly to the flashing thereby substantially decreasing the risk of crack formation in the acrylic dome. Moreover, the surface of the acrylic dome is imprinted to refract, a substantially increased amount of the natural light down into the light tube.

The lower end of the light tube extends to the inside surface of the ceiling thereby substantially increasing the dispersion of the light rays entering the building. The lower end of the light tube also sits on the plaster ring thereby substantially reducing the accessability of dust, water and bugs inside the building. The upper end of the light tube is reciprocally received into the flashing, but the outer dome attaches directly to the flashing. Consequently, the light tube "floats" inside the flashing thereby providing a more flexible system to compensate for "roof sag." Moreover, the floating light tube allows the manipulation of the flashing (i.e., to replace shingles) without the need to disassemble the entire system.

12 Claims, 3 Drawing Sheets

FIG. 3
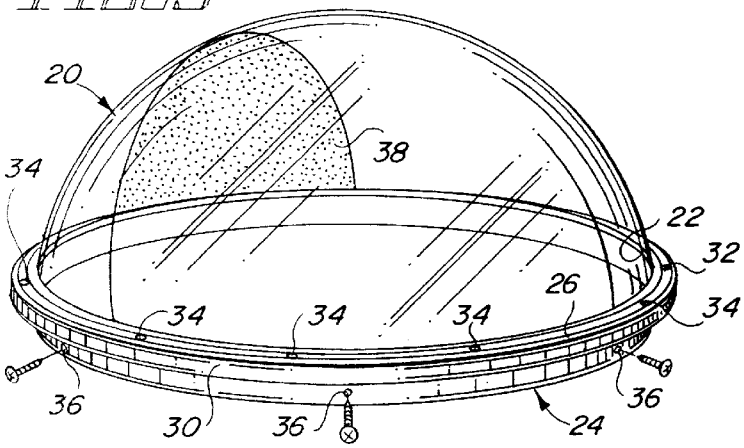
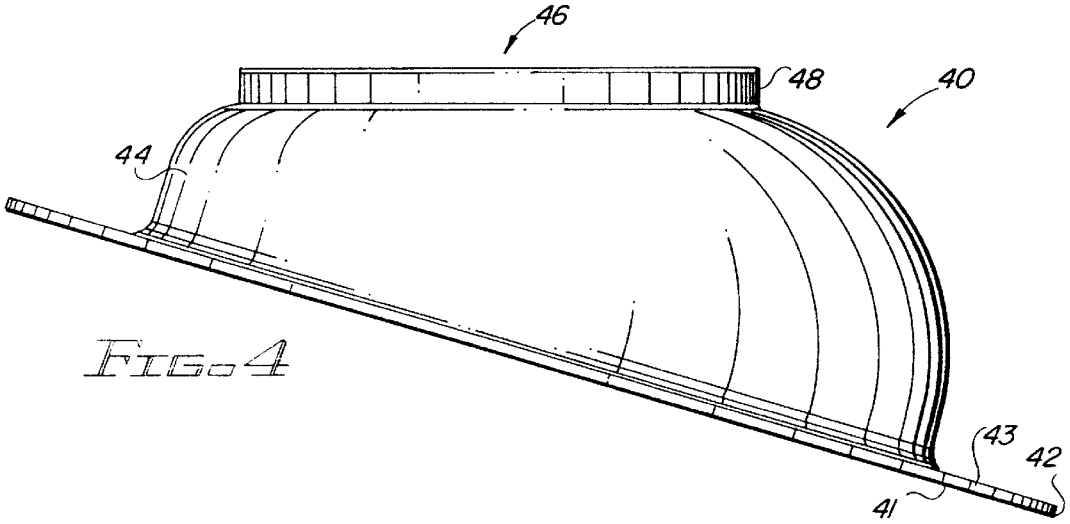
FIG. 4
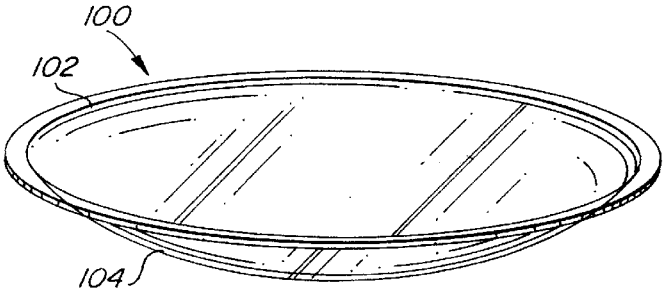
FIG. 7
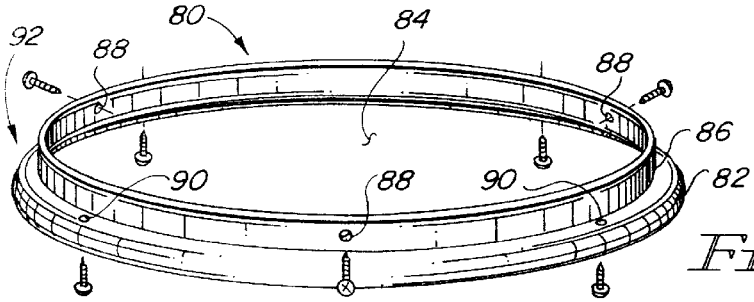
FIG. 6

METHOD AND APPARATUS FOR A TUBULAR SKYLIGHT SYSTEM

TECHNICAL FIELD

The present invention relates, generally, to a method and apparatus for a tubular skylight system, and more particularly, to a method and apparatus for inputting an increased amount of outdoor sunlight, through an attic, and into a building.

BACKGROUND ART AND TECHNICAL PROBLEMS

In a typical skylight arrangement, a hole is cut into a roof of a building and a clear dome is installed, thereby allowing natural light to enter the building. Incorporating a skylight system into a building which includes an attic (or other spacing between the outside of the building and the room which is to receive the light) most often requires a tubular skylight system. A tubular skylight system typically allows natural light to pass through a clear outer dome, reflect in a cylindrical light tube that spans the height of the attic space, then enter the room through a diffuser (see FIG. 1).

During the summer months, in most places, an adequate amount of light enters the skylight system because the sun is substantially above the clear outer dome, thus allowing direct rays of sun to enter the cylindrical light tube. However, during the winter months, the sun's rays often perpendicularly intersect the sides of the clear outer dome, thereby forcing a large portion of the rays to go directly through the outer dome without ever entering the cylindrical light tube. To deflect a large portion of the substantially perpendicular rays down into the light tube, many of the present tubular skylight systems incorporate a reflective material on the inside surface of the clear outer dome. However, installing a reflector onto the clear outer dome typically results in a large portion of the clear outer dome (ie., approximately ⅓ of the surface area of the dome) being covered by the reflective material. Consequently, during summer months, certain of the sun's rays would often intersect the backside of the reflective material and be restricted from entering the light tube, thereby reducing the amount of light entering the enclosed building.

Tubular skylight systems typically include a flashing which is secured to the outside surface of the roof. The flashing is often designed such that the light tube is reciprocally received through the inside of the cylindrical extension of the flashing and a clear outer dome is secured to the top end of the flashing (see FIG. 1). Fastening the outer dome directly to the flashing often prevents the escape of heat or condensation which typically builds up inside the tubular skylight system. Moreover, when securing the outer dome to the flashing, prior art systems often incorporate screws or bolts which, upon installation or over time, tend to crack the outer dome from the point pressure.

The light tube typically extends from the top of the flashing down to the top of the inner ceiling of the building. The lower end of the light tube (the end which abuts the inner ceiling) typically sits on the top surface of the inner ceiling (see FIG. 1). Consequently, the light tube is often rigidly secured between the inner ceiling and the flashing, thereby rigidly isolating the flashing from movement. Because of the rigidity of the flashing, when snow collects on the roof surface and forces the roof to sag slightly downward, the entire tubular skylight system is often forced upward and away from the outer roof allowing the entry of air, water and pests into the attic. Additionally, when replacing roof shingles, the flashing is typically lifted such that the shingles can be properly placed underneath the flashing. However, because of the rigidity of prior art systems, lifting of the flashing would require the difficult disassembly of the outer dome and light tube.

Furthermore, the abutment of the lower end of the light tube on the top surface of the inner ceiling (see FIG. 1) often provides unwanted collimation of the entering sunlight rays due to the side surface of the opening in the inner ceiling. Additionally, due to the placement of the lower end of the light tube on the top surface of the inner ceiling, to avoid the entry/exit of light rays or the entry/exit of unwanted air or bugs, the light tube is typically required to be set substantially perpendicular to the surface of the inner ceiling.

SUMMARY OF THE INVENTION

The present invention includes an improved tubular skylight system having a substantially clear acrylic outer dome, a metal flashing, a light tube, a ceiling plaster ring, and a prismatic diffuser. The outer dome includes an aluminum ring around the base of the dome which contains a circular channel and holes which provide for increased heat dissipation and condensation removal. The aluminum ring allows the outer acrylic dome to be attached directly to the flashing thereby substantially decreasing the risk of crack formation in the acrylic dome. Moreover, the surface of the acrylic dome is mechanically altered to refract, a substantially increased amount of the natural light down into the light tube.

The lower end of the light tube extends to the inside surface of the ceiling thereby substantially increasing the dispersion of the light rays entering the building. The lower end of the light tube also sits on the plaster ring thereby substantially reducing the accessability of dust, water and bugs inside the building. The upper end of the light tube is reciprocally received into the flashing, but the outer dome attaches directly to the flashing. Consequently, the light tube "floats" inside the flashing thereby providing a more flexible system to compensate for "roof sag." Moreover, the floating light tube allows the manipulation of the flashing (i.e., to replace shingles) without the need to disassemble the entire system.

BRIEF DESCRIPTION OF THE DRAWING FIGURES

The present invention will hereinafter be described in conjunction with the appended drawing figures, wherein like numerals denote like elements, and:

FIG. 3 shows a perspective view of a preferred embodiment of the outer dome of the present invention;

FIG. 4 shows a perspective view of a preferred embodiment of the flashing of the present invention;

FIG. 6 shows a perspective view of a preferred embodiment of the plaster ring of the present invention;

FIG. 7 shows a perspective view of a preferred embodiment of the diffuser of the present invention;

DETAILED DESCRIPTION OF PREFERRED EXEMPLARY EMBODIMENTS

Figure 8:
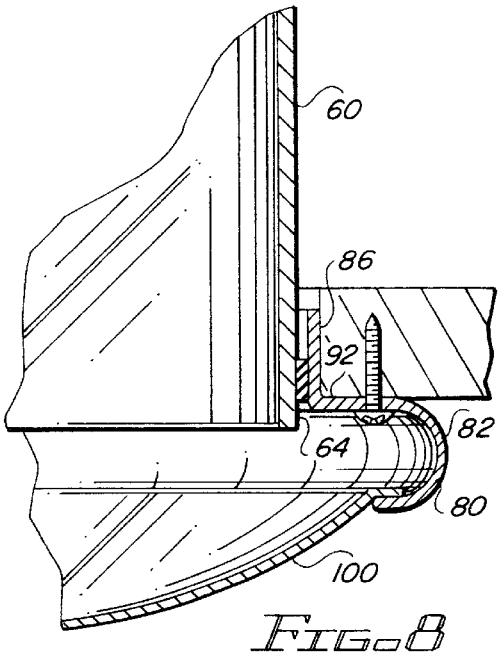
FIG. 8 shows a cut-away view of a preferred embodiment of the plaster ring and light tube installed at the inner ceiling.
Figure 2:
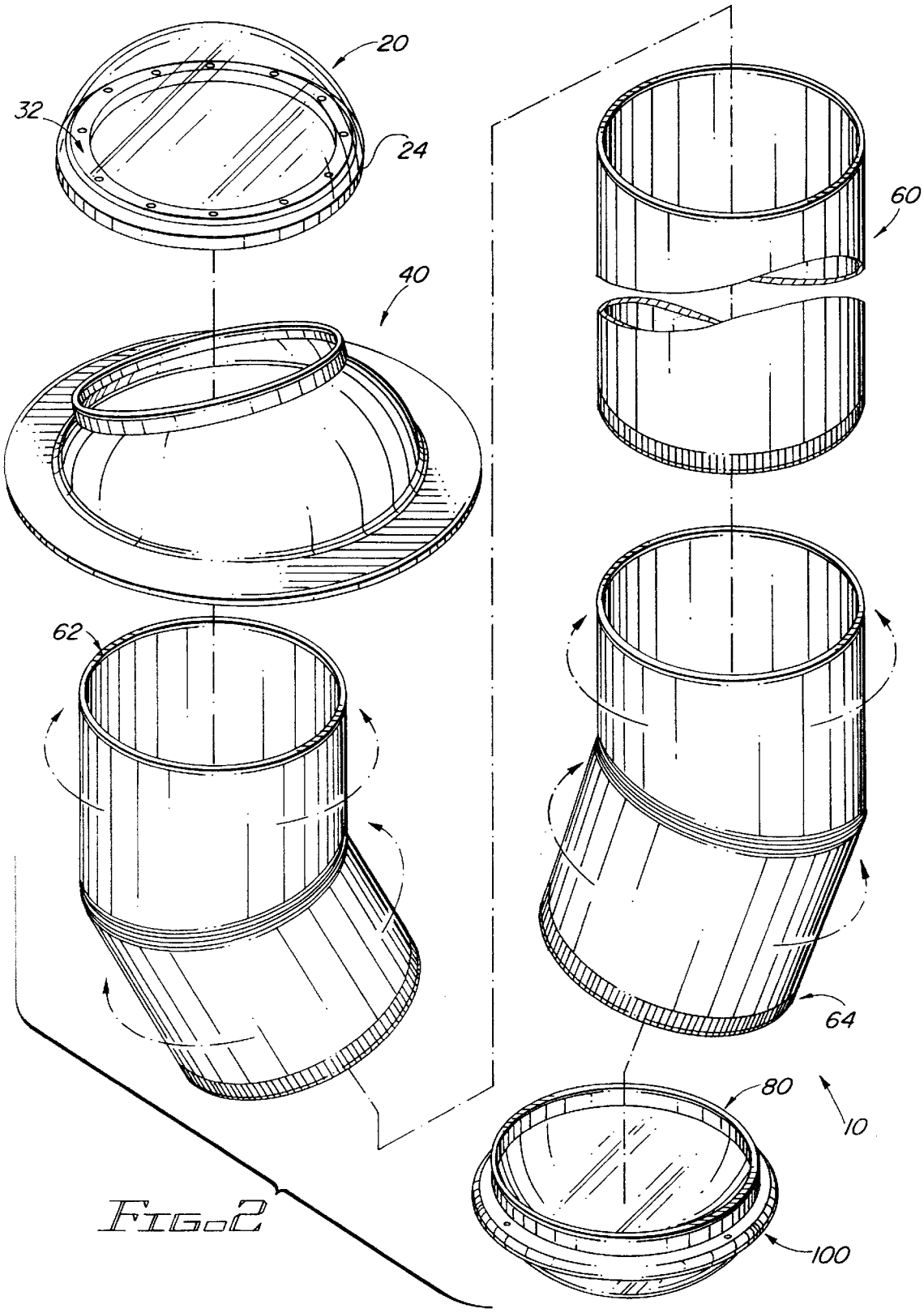
FIG. 2 shows an exploded view of a preferred embodiment of the present invention.

With reference to FIG. 2, the present tubular skylight system 10 preferably includes an outer dome 20, a flashing 40, a light tube 60, a plaster ring 80 and a diffluser 100. In general, in a preferred embodiment, outer dome 20 is securely directly attached to flashing 40 while first end 62 of light tube 60 is reciprocally received within flashing 40 (see FIG. 9) and second end 64 of light tube 60 rests upon, and is attached to, plaster ring 80, thereby allowing light tube 60 to "float" in flashing 40 (see FIG. 8).

More particularly, with reference to FIG. 3, outer dome 20 suitably comprises any cover capable of allowing the transmission of light rays while substantially preventing access to air, water, pests and/or the like. In accordance with a preferred embodiment of the present invention, outer dome 20 comprises a 3/16", G-grade or MC-grade, thermal formed, Atohaas UV stabilized clear acrylic dome 20. Outer dome 20 is preferably substantially hemispherical in shape and is preferably securely attached around the entire circumference of its base 22 to the circumference of a dome ring 24. In a preferred embodiment, flashing 40, light tube 60, plaster ring 80 and dome ring 24 are all formed of aluminum thereby preventing problems associated with electrolysis (i.e., rusting) and coefficients of expansion differences (i.e., cracking).

With continued reference to FIG. 3, dome ring 24 is preferably substantially circular in shape and preferably formed of aluminum. Dome ring 24 is preferably U-shaped with an upper surface 26 forming the top of the U and two flanges 28, 30 emanating down forming the sides of the U. Upper surface 26 preferably includes a channel 32 along the entire circumference of upper surface 26 with holes 34 substantially equally spaced around the circumference of upper surface 26 and within channel 32. Inner flange 28 emanates substantially perpendicularly from upper surface 26, thereby forming a flat circular internal ring. The face of the flat surface of inner flange 28 preferably includes four holes 36 equally spaced around the circumference of inner flange 28 such that holes 36 on inner flange 28 are perpendicular to holes 34 on upper surface 26 of dome ring 24. Outer flange 30 preferably emanates, from upper surface 26, approximately half the distance of inner flange 28 such that the bottom edge of outer flange 30 terminates before reaching holes 34 in the side surface of inner flange 28. The bottom surface of outer flange 30 preferably curves outward away from inner flange 28 and back upward toward upper surface 26, thereby forming a U-shaped channel (inverse of the U-shape of ring 24) on the outside circumference of outer flange 30. In other words, dome ring 24 is substantially a sideways S-shape.

Figure 9:
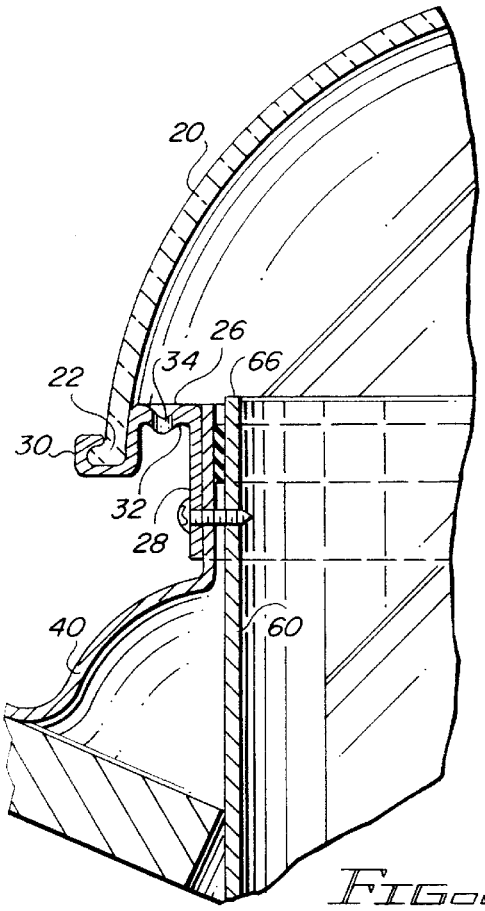
FIG. 9 shows a cut-away view of a preferred embodiment of the assembled dome, light pipe and flashing.

With reference to FIGS. 2 and 3, and as more fully described below, outer dome 20 is suitably attached to flashing 40 through holes 36 on the side surface of inner flange 28 such that holes 34 and channel 32 within upper surface 26 are preferably located on the outside of flashing 40 and light tube 60 providing for the efficient dissipation of heat and moisture to the outside environment and preventing the heat and moisture from traveling down the inside of light tube 60. More particularly, base 22 of outer dome 20 preferably sits within the outside channel of outer flange 30 and the edge of upper surface 26 abuts the inside wall of outer dome 20, thereby enclosing upper surface 26 of rim 24 within dome 20. As best seen in FIG. 9, outer flange 30 suitably wraps around base 22 thereby applying substantially even pressure against base 22 without the need for glues. Consequently, channel 32 and holes 34 are preferably enclosed within outer dome 20 (but outside of flashing 40 and light tube 60) thereby allowing for heat and/or condensation to exit from the inside area of outer dome 20 to the outside environment. Therefore, condensation, which typically builds up on the inside surface of outer dome 20, preferably travels down the inside surface of outer dome 20 and falls into channel 32 on upper surface 26 of dome ring 24, and subsequently, travels along channel 32 until the condensation exits to the outside environment through any one of holes 34 formed within channel 32.

In a preferred embodiment of the present invention, and with reference to FIG. 3, an approximately ⅓ contiguous portion 38 on one side of the inner surface of outer dome 20 is imprinted, without chemical alteration, by a vacuum/pressure thermal mold imprintation method to allow for the refraction of substantially non-parallel 60. The light rays are suitably refracted into light tube 60 because the vacuum/pressure thermal mold imprintation of the acrylic material of dome 20 suitably increases the amount of light rays refracted off of the surface. Alternatively, the imprintation represents a Fresnel lens for increased reflection. Another alternative embodiment varies the angles of imprintation along outer dome 20 such that a substantially increased number of rays are reflected and/or refracted into light tube 60. The aforementioned refraction features provide increased light scattering which increases the amount of light into inner tube 60 and results in a substantially equally spread of the light over diff-user 100 thereby substantially reducing shadowing (i.e., less light on one portion of diffuser 100 surface) over diffuser 100 surface.

The inside surface of outer dome 20 is imprinted by any suitable method which increases the refraction capabilities of a material. In a preferred embodiment, the inside surface of outer dome 20 is preferably imprinted by placing a substantially flat piece of acrylic material over a vacuum chamber and heating the acrylic material to between approximately 290–325 degrees. Vacuum suction is applied to the bottom surface of the material thereby forming a substantially hemispherical surface. Next, a mold having a male pattern formed thereon on, is placed on the top surface of the acrylic hemispherical dome 20 surface and pressure is applied to the bottom surface of the hemispherical dome 20 surface, thereby forcing the hemispherical dome 20 surface against the male mold, and consequently, imprinting a female pattern onto the inside surface of dome 20. The male mold includes substantially rounded projections such that the imprinted pattern does not substantially reduce the thickness of the surface of dome 20. By substantially preserving the thickness of dome 20, the strength of dome 20 surface is substantially preserved. Additionally, during the entire process, the outside surface of dome 20 is unaltered, except for subsequent polishing, which provides a smooth outer surface which prevents the collection of dust, dirt and the like.

With reference to FIG. 4, flashing 40 preferably includes a circular disk 42 having a top surface 43, a bottom surface 41 and a spherical flange 44 emanating from the central portion of top surface 43 of circular disk 42. Spherical flange 44 preferably includes an opening 46 which is preferably offset from the center apex of spherical flange 44. Opening 46 within spherical flange 44 preferably includes a second circular flange 48 which emanates perpendicular to the spherical surface of flange 44 such that, when flashing 40 is placed on a horizontal surface, flange 48 is preferably at about a 15 degree angle to the horizontal surface. Offset opening 46 and flange 48 allow outer dome 20, which suitably attaches to flange 48, to be angled at an optimal angle to allow dome 20 to be horizontal to the earth's surface, thus capturing an increased amount of sunlight throughout the year, even when flashing 40 is placed on a pitched roof. Alternatively, opening 46 of flashing 40 can be formed at any angle to conform to any roof pitch, including no angle for flat roofs.

Circular disk 42 preferably includes a hole toward its outer edge for securing flashing 40 to the roof of the building. Flashing 40 is preferably formed of aluminum, but alternatively, flashing 40 can be formed of any suitable material and of any shape. In a preferred embodiment, spherical flange 44 is formed by a known spin process and perpendicular flange 46 is formed by a known hydroforming process. The spin and hydroforming processes enable the relatively easy and inexpensive production of flashing 40 at different angles for different roof pitches. In an alternative embodiment, disk 42, spherical flange 44, and circular perpendicular flange 46 can be formed by a draw-redraw process or can be three separate pieces attached by any suitable means. For example, disk 42, spherical flange 44 and perpendicular circular flange 46 can be joined by soldering, glue, and/or the like.

Figure 1:
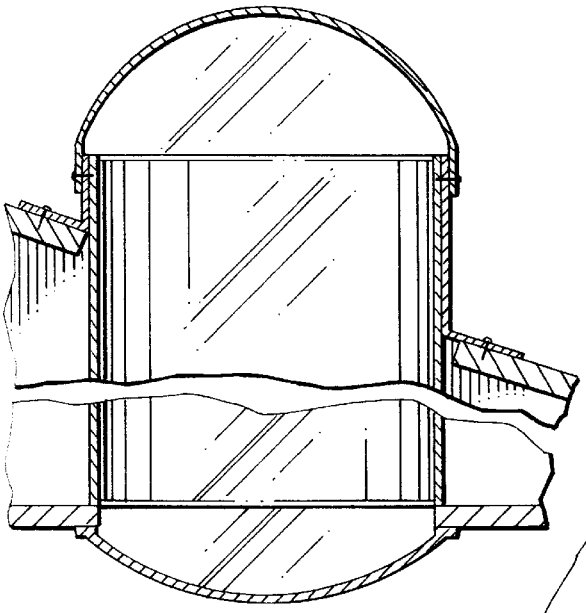
FIG. 1 (PRIOR ART)
FIG. 1 shows an exemplary prior art tubular skylight system.
Figure 5:
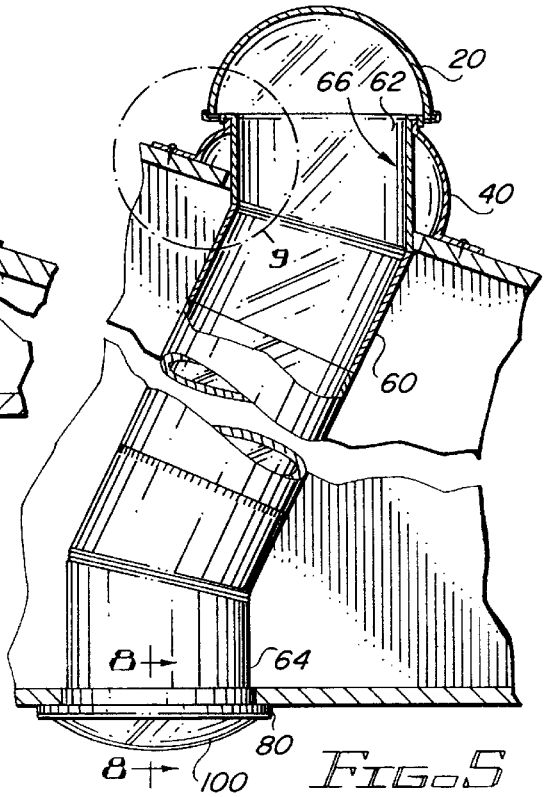
FIG. 5 shows a perspective view of a preferred embodiment of the light tube in accordance with the present invention.

With reference to FIG. 5, light tube 60 preferably includes a rectangular piece of tin having one side 66 which is highly reflective. In a preferred embodiment, light tube 60 includes a Super Reflective Specular+Light Tube developed by the Specular+) Company. The rectangular piece of tin is suitably rolled lengthwise to form cylindrical tube 60 for incorporation into tubular skylight system 10. The highly reflective nature of internal surface 66 of tube 60 allows for the transmission and reflection of the light which enters outer dome 20, thereby substantially conserving the intensity of the light by restricting the light from dispersing into an unwanted area (i.e., an attic), and instead, guiding the light through diffuser 100 and into the building. In northern latitudes, light tube 60 is preferably installed with its upper end 62 angled slightly southward (see FIG. 2), thereby increasing the amount of light entering light tube 60 and exiting through diffuser 100. Second end 64 of light tube 60 preferably ends approximately ¼" below inner ceiling (see FIG. 8).

With reference to FIG. 6, plaster ring 80 is preferably a circular disk formed of aluminum. The outer edge 82 of plaster ring 80 is preferably rolled inward thereby forming a C-shaped ledge with the opening of the "C" pointing inward toward the center of plaster ring 80. The center of plaster ring 80 preferably includes a circular opening 84 with the inner rim of ring 80 curved substantially perpendicular to the ring's 80 surface thereby forming an inner perpendicular circular flange 86 on the inner circumference of the disk. Inner flange 86 includes a small hole 88 in the perpendicular face of inner flange 86. The surface of ring 80, between inner flange 86 and the outer C-shaped edge 82 includes four equally spaced holes 90. With respect to FIG. 8, second end 64 of light tube 60 preferably ends approximately ¼" below inner ceiling so plaster ring hides light tube 60 from view. As more fully explained below, second end 64 of light tube 60 is preferably reciprocally received inside inner flange 86 while the top surface 92 of plaster ring 80 is preferably securely attached against the ceiling surface thereby providing a substantially air tight enclosure. Thus, plaster ring 80 hides the inner ceiling opening, holds light tube 60 and holds diffuser 100.

With reference to FIG. 7, diffuser 100 can be of any shape and made of any suitable material. In a preferred embodiment, diffuser 100 is a bowled shape with a flange 102 emanating horizontally from the upper rim of bowl 104. Diffuser 100 is preferably a plexiglass clear prismatic diffuser 100. In an alternative embodiment, diffuser 100 is a white plexiglass material. As more fully explained below, outer flange 102 of diffuser 100 sets within, and has a slightly smaller circumference than, the outer C-shaped edge 82 of plaster ring 80. The combined light exiting light tube 60 passes through bowled diffuser 100 which subsequently redirects the light rays in various directions thereby providing indirect light into the building. Due to the structure and composition of diffluser 100, different styles of diffuser 100 can be easily installed into plaster ring 80.

With respect to FIG. 2, in a preferred embodiment, to install tubular skylight system 10, a substantially circular opening, approximately the circumference of the base of spherical flange 44 of flashing 40 is preferably cut into the roof surface. Circular disk 42 of flashing 40 is suitably slid under the existing tar paper and shingles, then roof caulking is preferably spread between bottom side 41 of flashing 40 and the roof surface. Next, a substantially circular opening, slightly larger than the circumference of inner flange 86 of plaster ring 80 is preferably cut in the ceiling of the room. Inner flange 86 of plaster ring 80 is suitably reciprocally received in the hole in the room ceiling and plaster ring 80 is suitably secured to the ceiling. In a preferred exemplary embodiment, screws are inserted into each of four holes 90 along top surface 92 of plaster ring 80 to secure plaster ring 80 to the ceiling (see FIG. 8). Light tube 60 is suitably trimmed to approximately the distance between the inner ceiling and the outer roof. Upper end 62 of light tube 60 is preferably reciprocally received into flashing 40 (see FIG. 9) and second end 64 of light tube 60 is preferably placed around inner flange 86 of plaster ring 80 and suitably secured to inner flange 86 through holes 88 (see FIG. 8). Alternatively, light tube 60 is angled and angled light tube connectors are incorporated at either end of light tube 60. Next, inner flange 28 of outer dome 20 is preferably reciprocally received within, and suitably secured to, circular inner flange 48 of flashing 40. In a preferred embodiment, screws are inserted through holes 36 in inner flange 28 of outer dome 20. Lastly, the circumference of diffuser 100 is preferably temporarily bent inward to allow it to be reciprocally received within C-shaped outer ring 82 of plaster ring 80.

Although the invention has been described herein with reference to the appended drawing figures, it will be appreciated that the scope of the invention is not so limited. Various modifications in the sequence of steps, the composition of the materials, the shape of the components and arrangement of components may be made without departing from the spirit and scope of the invention as set forth in the appended claims. For example, light pipe tape seal, PVC foam tape seal, aluminum foil tape, gaskets and/or the like can be incorporated at any location within tubular skylight system 10.

I claim:

1. A skylight system including:

a flashing;

first cover directly attached to said flashing, said first cover including a channel and holes for capturing and removing at least one of condensation and heat, said holes exiting to an outside environment; and a light tube having a first end and a second end, said first end of said light tube reciprocally received within said flashing.

2. The system of claim 1 wherein said flashing includes a spherical flange, said spherical flange having an opening surrounded by a second flange, said first cover reciprocally receiving said second flange, said second flange being at an angle greater than zero degrees with a horizontal surface.

3. The system of claim 1 further including a plaster ring for supporting said second end of said light tube, said second end of said light tube extending slightly into a room and reciprocally received into said plaster ring to provide an air tight enclosure.

4. The system of claim 3 further comprising a second cover, said second cover removably reciprocally received within said plaster ring.

5. The system of claim 1 wherein said second end of said light tube extends past an inside surface of a ceiling within a building, thereby increasing the dispersion of light rays within said building.

6. The system of claim 1 wherein said first cover includes an inside surface having an inside surface area, said first cover allowing light to enter said system and located on an outside of a building, said first cover having a portion of said inside surface area imprinted to increase refraction off of said portion of said inside surface area, thereby increasing an amount of light rays entering said light tube.

7. A skylight system including a light tube and a first cover extending above the light tube, the first cover having an inside surface containing an inside surface area, said first cover allowing light to enter said system and located on the outside of a building, said first cover having a portion of said inside surface area imprinted to increase refraction off of said portion of said inside surface area, thereby increasing the amount of light rays entering said light tube.

8. A method of constructing a skylight system comprising the steps of forming a first opening in a roof and a second opening in a ceiling of a building;

providing a flashing;

securing said flashing over said first opening;

providing a light tube having a first end and a second end;

positioning said first end of said light tube within said flashing; and, securing a first cover to said flashing, said first cover including a channel and holes for capturing and removing at least one of condensation and heat, from within said system said holes exiting to an outside environment.

9. The method of claim 8 further including;

securing a plaster ring over said second opening;

positioning said second end of said light tube slightly into a room and within said plaster ring; and, attaching a second cover to said plaster ring to provide a substantially air tight enclosure.

10. The method of claim 8 wherein said step of providing a flashing includes providing a flashing having a spherical flange, said spherical flange having an opening surrounded by a second flange, reciprocally receiving said second flange by said first cover, said second flange being at an angle greater than zero degrees with a horizontal surface.

11. The method of claim 8 wherein said step of providing said light tube includes providing said second end of said light tube extending to an inside surface of a ceiling within a building, thereby increasing the dispersion of light rays within said building.

12. The method of claim 8 wherein said step of providing said first cover includes providing said first cover having an inside surface containing an inside surface area, imprinting a portion of said inside surface area of said first cover to increase light refraction on said portion of said inside surface area, thereby increasing the amount of light rays entering said light tube.

* * * * *

UNITED STATES PATENT AND TRADEMARK OFFICE

CERTIFICATE OF CORRECTION

PATENT NO. : 5,878,539

DATED : March 9, 1999

INVENTOR(S) : Dennis Grubb

It is certified that error appears in the above-identified patent and that said Letters Patent are hereby corrected as shown below:

Column 1, line 38, delete "ie.," and insert therefore --i.e.,--.
Column 2, line 28, delete ",".
Column 2, line 60, insert hard return after "invention;".
Column 4, line 17, after "non-parallel" insert --(i.e., "non-parallel" to the sides of light tube 60) light rays downwards into light tube--.
Column 4, line 29, delete "-" in the word diffuser.
Column 5, line 28, delete ")" after Specular+.
Column 6, line 11, delete "diffluser" and insert therefore --diffuser--.
Column 6, line 59, insert --a-- before "first cover".
Column 7, line 5, delete "for".
Column 7, line 32, insert --:-- after "steps of".

Signed and Sealed this

Twenty-fourth Day of August, 1999

*Attest:*

Q. TODD DICKINSON

*Attesting Officer*

*Acting Commissioner of Patents and Trademarks*